US005849471A

United States Patent [19]

Haga

[11] Patent Number: 5,849,471

[45] Date of Patent: Dec. 15, 1998

[54] SILVER HALIDE LIGHT-SENSITIVE PHOTOGRAPHIC MATERIAL

[75] Inventor: Yoshihiro Haga, Hino, Japan

[73] Assignee: Konica Corporation, Japan

[21] Appl. No.: 816,644

[22] Filed: Mar. 13, 1997

[30] Foreign Application Priority Data

Mar. 13, 1996 [JP] Japan ..... 8-056124

[51] Int. Cl.[6] ..... G03C 1/047

[52] U.S. Cl. ..... 430/523; 430/527; 430/628; 430/639

[58] Field of Search ..... 430/639, 628, 430/523, 527

[56] References Cited

U.S. PATENT DOCUMENTS

| | | | |
|---|---|---|---|
| H1578 | 8/1996 | Taguchi | 430/523 |
| 4,999,276 | 3/1991 | Kuwabara et al. | 430/264 |
| 5,348,849 | 9/1994 | Ito | 430/574 |
| 5,376,517 | 12/1994 | Kurachi et al. | 430/523 |
| 5,719,015 | 2/1998 | Mihayashi et al. | 430/533 |

FOREIGN PATENT DOCUMENTS 0660174 6/1995 European Pat. Off. .

OTHER PUBLICATIONS

European Search Report EP97 30 1703.

*Primary Examiner*—Hoa Van Le
*Attorney, Agent, or Firm*—Jordan B. Bierman; Bierman, Muserlian and Lucas

[57] ABSTRACT

A silver halide light-sensitive photographic containing a hydrophilic colloid layer containg dextran or a compound of the following formula and subbing layer containing metal oxide is disclosed.

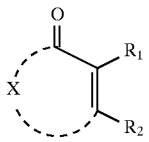

$R_1$ and $R_2$ each independently represent a hydroxy group, —OM group, an amino group, an acylamino group, an alkylsulfonylamino group, an arylsulfonylamino group, an alkoxycarbonylamino group, a mercapto group or an alkylthio group, and M represents an alkali metal atom or an ammonium group and X represents two vinyl carbons substituted by $R_1$ and $R_2$ and an atom group necessary for forming a 5–6 ring together with carbonyl carbon.

4 Claims, No Drawings

SILVER HALIDE LIGHT-SENSITIVE PHOTOGRAPHIC MATERIAL

FIELD OF THE INVENTION

This invention relates to a silver halide light-sensitive photographic material and its processing method, more specifically a silver halide light-sensitive photographic material having excellent antistatic properties and improved layer adhesion after development processing, and reduced remaining dye stain and its processing method.

BACKGROUND OF THE INVENTION

In recent years, not only the increase in sensitivity and the improvements in image quality but also the stability of performance have been strongly required for the silver halide light-sensitive photographic materials. In addition, more rapid processing has been also required. In order to meet the requirements, various studies have been made for the light-sensitive materials and the processing.

When the silver halide light-sensitive photographic materials are processed rapidly, materials such as film is rapidly transported in an automatic development processor. As the result, static electricity is easily built up by contact with the transport rollers and rubbing with the rollers, mutual contact of light-sensitive materials or separation from the contact, and the like. When discharged, fog called static marks is formed and causes fatal defects to images.

Many reports have been issued regarding antistatic methods such as antistatic agents for the silver halide light-sensitive photographic materials. For example, polymer electrolytes and various kinds of surface active agents have been well known. However, these antistatic agents have disadvantages in making a processing solution turbid or forming sludges in a processing solution due to the water-soluble property.

Recently, an antistatic method comprising metal oxides, especially fine particles of the metal oxides as conductive antistatic agents has been disclosed, for example, in Japanese Patent Publication Open to Public Inspection No. 104931/1982. This antistatic method has solved the problem which occurs in the processing solution due to the dissolution mentioned above. However, it has been found that layer adhesion (physical properties of a gelatin layer carrying images) is deteriorated and the layer is easily peeled off or easily scratched.

In addition, it has been found unexpectedly that when said method is practiced, spectral sensitizes or various kinds of dyes which are indispensable addenda in silver halide light-sensitive photographic materials are not easily dissolved out to the processing solution and dye stain remains on finished materials. Accordingly, improved technologies for conductive antistatic agents have been highly desired.

SUMMARY OF THE INVENTION

Accordingly, an object of the present invention is to provide a silver halide light-sensitive photographic material having excellent antistatic properties due to electric conductivity and improved layer adhesion after development processing and no remaining dye stain, and its processing method.

The silver halide light-sensitive photographic material of the invention is described.

The silver halide light-sensitive photographic material comprises a hydrophilic colloid layer at least one of which is a silver halide emulsion layer, and a subbing layer on a support. The colloid layer contains a dextran and the subbing layer contains a metal oxide.

In one of the another embodiment of the invention, the colloid layer contains a compound represented by the formula (1) and the subbing layer contains a metal oxide.

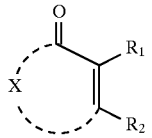

(1)

In the general formula, $R_1$ and $R_2$ each independently represent a hydroxyl group, —OM, an amino group, an acylamino group, an alkylsulphonylamino group, an arylsulfonylamino group, an alkoxycarbonylamino group, an mercapto group or an alkylthio group and M represents an alkali metal atom or an ammonium group and X represents an atom group necessary for forming a 5–6 membered ring together with two vinyl carbons having substituent $R_1$ and $R_2$ and a carbonyl carbon.

The silver halide light-sensitive photographic material is preferably processed by an automatic development processor having a mechanism for the supply of solid processing agent to a processing vessel.

DETAILED DESCRIPTION OF THE INVENTION

Firstly the metal oxide is explained which is used in the subbing layer in the present invention. The metal oxide includes, for example, crystalline fine particles or colloid of metal oxide such as an oxygen deficient oxide, a metal excess oxide, and a metal deficient oxide which are likely to form nonstoichiometric compounds. Among these, the preferred compound is colloidal metal oxides. The metal oxide compound is preferably electric conductive.

The colloidal metal oxide used in the invention is a dispersion of the metal oxide having an average particle sixe of 0.001 to 1 $\mu$m.

In practice, said metal oxide includes the oxidation product or a complex oxidation product of zinc, magnesium, silica, calcium, aluminum, strontium, barium, zirconium, titanium, manganese, iron, cobalt, nickel, tin, indium, molybudenum or vanadium. The preferable examples include ZnO, $TiO_2$, $SnO_2$, $Al_2O_3$, $In_2O_3$, $SiO_2$, MgO, $B_2O$, $V_2O_5$, BaO and $MoO_3$ and their complex oxides such as ZnO complexed with Al, In or so, $SnO_2$ complexed with Sb, Nb etc., and $In_2O_3$ complexed with Sb etc. In the present invention, a colloidal tin oxide is practically preferable.

Examples of the crytalline metal oxides, their preparation process and their application to a silver halide light-sensitive photographic material are described in, for example, Japanese Examined Patent Publication Nos. 1-20735 and 1-1020733 and Japanese unexamined Patent Publication No. 58-62647.

Examples of the colloidal metal oxides, their preparation process and their application to a silver halide light-sensitive photographic material are described in, for example, Japanese unexamined Patent Publication No. 7-319122. In U.S. Pat. No. 4,203,769 colloidal vanadium oxide, its preparation process and its application to a silver halide light-sensitive photographic material are described.

A preparation method of colloidal tin oxide is described as an example of the colloidal metal oxide. Fine particles of tin oxide are dispersed into a suitable solvent or a solvent-soluble stannic compound is decomposed in the solvent. Either method may be practiced.

As for the manufacturing method utilizing the fine particles of tin oxide, temperature setting conditions are specially important. A heat process at high temperature is not recommended because of the growth of primary particles and the formation of crystals. When the heat process at high temperature is required, the temperature should be lower than 300° C., preferably lower than 200° C. and more preferably lower than 150° C. However, the temperature range of 150°–250° C. is suitable for the dispersion to a binder.

There are the other methods such that a stannic compound prepared by a wet process is sprayed into an electric furnace; an organic stannic compound is decomposed at high temperature; a tin oxide is redispersed into a solvent after the purification process. However, above methods are not so suitable for the preparation of photographic antistatic agents.

When a solvent used at the preparation for the colloidal tin oxide dispersion is not well mixed with a binder used for the protection of colloid particles, a compound is added which are mutually soluble with the solvent used for the production in order to replace the solvent suitable for the dispersion to a binder or disperse stablly the fine particles of tin oxide. The mixture is heated at lower than 300° C., preferably lower than 200° C. and more preferably 150° C. Then fine particles of tin oxide together with the above added compounds are dried and separated and then are redispersed into water or water mixed with the other solvent.

For the method utilizing the decomposition of solvent-soluble stannic compound in a solvent, the following stannic compounds are available. Compounds containing oxo anions such as $K_2SnO_3.3H_2O$, water-soluble halides such as $SnCl_4$, $(CH_3)_3SnCl$.(pyridine) having structures e.g. $R'_2SnR_2$, $R_3SnX$, $R_2S_nX$, organic metal compounds e.g. $(C_4H_9)Sn(OCC_2H_5)_2$, oxo salts e.g. $Sn(SO_4)_2.2H_2O$.

Any of the stannic compounds is dissolved into a solvent and then, the colloidal tin oxide is prepared by physical means such as heating or pressing or by chemical means such as oxidation, reduction, hydrolysis, etc. Or the colloidal tin oxide is prepared via the intermediate.

For example, Japanese Patent Examined Publication No. 6616/1960 discloses a method for the preparation of a colloidal tin oxide by the following method. $SnCl_4$ is dissolved into distilled water of 100 times in volume and stannic hydroxide is precipitated. Then, to dissolve the precipitate, ammonia solution is added until the solution becomes weak alkaline. The solution is heated until no ammonia smells.

In addition to water, solvents include alcohol solvents such as methanol, ethanol or isopropanol, ether solvents such as tetrahydrofuran, dioxane or diethylether, aliphatic organic solvents such as hexane or heptane, or aromatic organic solvents such as benzene or pyridine. Various solvents may be used depending on stannic compounds. However, the preferred solvents are water or alcohols.

In this method, it is possible to add a solvent-soluble compound which contains an element besides tin. For example, a compound containing fluorine or metal compounds which can take the coordination number of 3 or 5 can be added.

Solvent-soluble compounds containing fluorine include ionic fluorides and fluorides having a covalent bond, for example, metal fluorides such as $K_2TiF_6$, HF, $KHF_2Sb$ or $F_3MoF_6$, compounds forming fluorocomplex anions such as $NH_4MnF_3$ or $NH_4BiF_4$, inorganic molecular fluorides such as $BrF_3$, $SF_4$ or $SF_6$ and organic fluorine compounds such as $CF_3I$, $CF_3OOH$ or $P(CF_3)_3$. In addition, when water is used as a solvent, a combination of an organic compound containing fluorine and a non-volatile acid may be used in the same way as the combination of $CaF_2$ and sulfuric acid.

Solvent-soluble metal compounds which can take the coordination number of 3 or 5 include a series of compounds which contain III Group elements such as Al, Ga, In or Tl or V Group elements such as P, As, Sb or Bi, or transition elements such as Nb, V, Ti, Cr, Mo, Fe, Co or Ni which can take the coordination number of 3 or 5.

(Example 1: Preparation of Colloidal Tin Oxide)

Sixty-five (65) grams of stannic chloride hydrate was dissolved into 2,000 cc of a water/ethanol mixture and a homogenious solution was obtained. Then, the solution was boiled to obtain a coprecipitate. The precipitate was collected by decantation and washed well by distilled water. After confirming that by dropping an aqueous silver nitrate solution to the water which had washed the precipitate, no reaction due to chloride ions occurred, distilled water was added to the washed precipitate to make 2 liters in total. To the solution, 40 cc of a 30% ammonia solution was added and then, the resulted solution was heated in a water bath and a colloidal tin oxide was obtained.

(Example 2: Preparation of Colloidal Tin Oxide)

Sixtyfive (65) grams of stannic chloride hydrate and 1.0 g of antimony trichloride were dissolved into 2,000 cc of a water/ethanol mixture. The solution was boiled and coprecipitate was obtained. The precipitate was collected by decantation and washed well by distilled water. After confirming that by dropping a silver nitrate solution to water which washed the precipitate, no reaction due to chloride ions occurs, distilled water was added to the washed precipitate to make a 2,000 cc solution. To the solution, 40 cc of a 30% ammonia solution was added. The resulted solution was heated in a water bath and a colloidal tin oxide was obtained. The volume specific resistance of the colloidal tin oxide thus obtained was $2.1\times10^{5}\Omega$cm.

Dextran contained in the hydrophilic colloid layer of the present invention is a polymer of D-glucose linked at the α-1,6 positions. When a sucrose solution is processed by dextran producing bacteria such as Leuconostoc mesenteroides obtained by the culture of saccharides or by dextran sucrose which is isolated from the culture solution, native dextran is prepared. Then, the native dextran is decomposed to desired molecular weight by a partial decomposition gravimetric method in the presence of acids, alkalis or enzymes.

The weight average molecular weight of the dextran used in the present invention is 5,000 to 300,000 preferably 15,000 to 100,000 and more preferably 20,000 to 70,000.

The dextran may be added to any of hydrophilic colloid layers. When there are plural hydrophilic layers, it is preferable to add the dextran to the layer nearest to the subbing layer.

When the dextran is added to the hydrophilic colloid layer, a preferred amount is 5–50 weight percent of the total weight of the binders in the hydrophilic colloid layer and a more preferred amount is 10–45 weight percent.

In the present invention, it is preferable that the hydrophilic colloid layer contains the compounds represented by the general formula (1).

In the general formula (1), $R_1$ and $R_2$ each independently represent a hydroxyl group, —OM (M represents an alkali metal atom or an ammonium group.), an amino group (including an alkyl group as a substituent group having from 1 to 10 carbon atoms such as a methyl group, an ethyl group, a n-butyl group, a hydoxyethyl group, etc.), an acylamino group (acetylamino group, benzoylamino group, etc.), an alkylsulfonylamino group (methane sulfonylamino group, etc.), an arylsulfonylamino group (benzenesulfonylamino group, p-toluenesulfonylamino group, etc.), an alkoxycarbonylamino group (methoxycarbonylamino group, etc.), a mercapto group and an alkylthio group (methylthio group, ethylthio group, etc.). Preferred groups include a hydroxy group, an amino group, an alkylsulfonylamino group and an arylsulfonylamino group. X represents —O—, —C($R_3$)($R_4$)C—, —C($R_5$)C═, —C(═O)—, —N($R_6$)—, —N═, etc. and preferred carbon atom, oxygen atom or nitrigen atom, and forms a 5–6 membered ring together with two vinyl carbons having substituents $R_1$ and $R_2$ and a carbonyl carbon. In the formula, $R_3$, $R_4$, $R_5$ and $R_6$ are each independently a hydrogen atom, an alkyl group having from 1 to 10 carbon with substitutes (hydoxyl group, caboxy group, sulfo group, etc.), an aryl group having from 6 to 15 carbon atoms with a substitute (alkyl group, halogen atom, hydroxy group, carboxy group, sulfo group, etc.). The formed 5 or 6 membered ring may be a saturated or unsaturated fused ring such as a dihydrofuranone ring, a dihydropyrone ring, a pyranone ring, a cyclopenenone ring, a cyclohexenone ring, a pyrrolinone ring, a pyrazolidone ring, a pyridone ring, an azacyclohexenone ring, a uracil ring, etc. Preferred rings are the dihydrofuranne ring, the cyclopentenone ring, the cyclohexenone ring, the pyrazolidone ring, the azacyclohexenone ring and the uracil ring.

The following are examples of the compounds represented by the general formula (1).

A-1

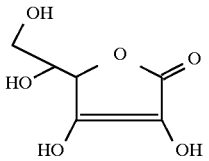

A-2

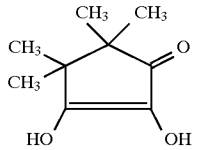

A-3

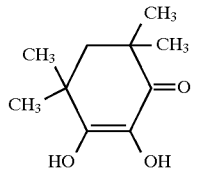

A-4

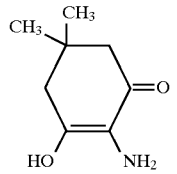

A-5

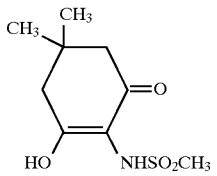

-continued

A-6

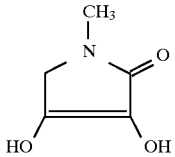

A-7

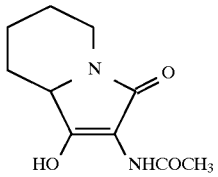

A-8

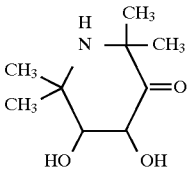

A-9

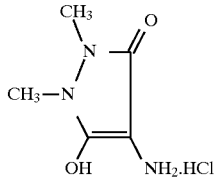

A-10

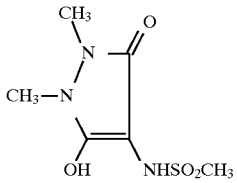

A-11

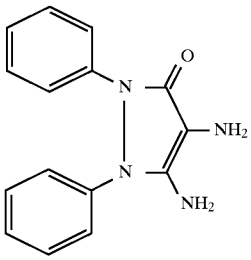

A-12

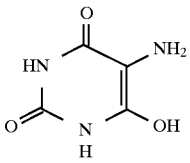

A-13

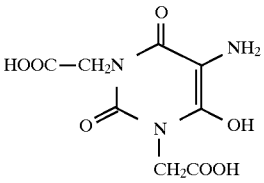

-continued

A-14

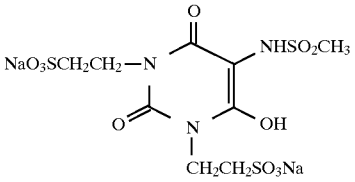

A-15

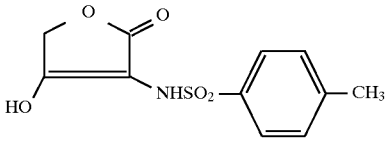

A-16

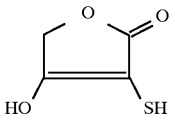

A-17

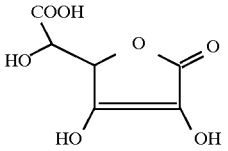

A-18

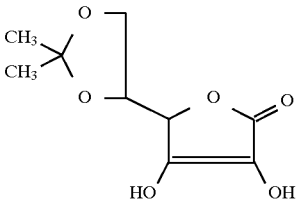

A-19

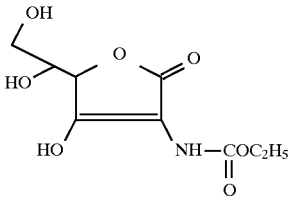

A-20

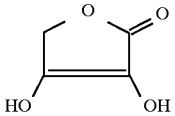

A-21

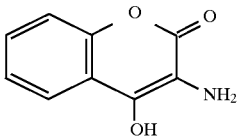

A-22

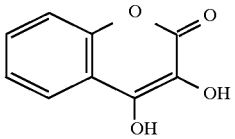

A-23

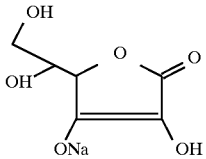

When the compounds represented by the general formula (1) are acids, the free acids and their salts may be included.

The compounds represented by the general formula (1) may be added to any of hydrophilic colloid layers. When there are plural hydrophilic colloid layers, it preferable to add the compounds to the hydrophilic colloid layer nearest to the subbing layer.

When the compounds represented by the general formula (1) are added to silver halide emulsion layers, a preferred amount is $5\times10^{-6}$–$1\times10^{-1}$ mole per 1 mole of silver halide and a more preferred amount is $1\times10^{-5}$–$1\times10^{-2}$ mole per 1 mole of silver halide.

When the compounds represented by the general formula (1) are added to gelatin layers which are not sensitive to light, a preferred amount is $5\times10^{-7}$–$1\times10^{-2}$ mole/$m^2$ and a more preferred amount is $1\times10^{-6}$–$1\times10^{-3}$ mole/$m^2$.

Halide compositions in silver halide grains used in the present invention may contain any halides which form silver bromide, silver iodobromide, silver chloroiodobromide, silver chlorobromide, silver chloride, silver chloroiodide or silver iodide.

Silver halide grains used in the present invention may be regular crystal grains such as cubes, tetradecahedra or octahedra, or spheres, tablets, or twins having a apect ratio of 2 or less, or potato-like deformed grains, In the present invention, a silver halide grain is defined as a sphere, if a ridge line between polygons forming the grain surface has roundness expressed by a radius curvature corresponding to 1/10L–1/2L where L is the length of the largest area of the polygon. The roundness of the silver halide grain can be obtained by the measurement using an electron microscope.

In monodispersed silver halide grains used in the present invention, the weight of grains having a diameter of d±20% where d is an average diameter of the grains is more than 60 weight percent of the total weight of silver halide. A preferred weight is more than 60% in weight and a more preferred is more than 70% in weight. The most preferred weight is more than 80% in weight. Here, the average diameter d of the grains is defined as di when the product of $ni\times di^3$ gives the maximum value, where di is a diameter of each grain and ni is the number of grains having the diameter di. (Three figures are effective, being rounded off at the smallest digit.)

The grain diameter in the present invention means a diameter in case of a spherical silver halide grain. When the silver halide grain is not spherical, a projection area of the grain is converted to a circle which has the same area as the projected area and the diameter of the circle is referred to as a diameter of the unspherical grain.

The grain diameter can be measured, for example, with use of grain photographs obtained by an electron microscope under magnification of 10,000 to 50,000 times. As mentioned above, for the spherical grain, the diameter of the grain on the photograph is measured and for the unspherical grains, the area is measured to obtain the diameter. (For this measurement, more than 1,000 grains should be randomly sampled.)

Grains of a monodispersed emulsion have 20 percent or less of the size distribution width. A preferred distribution width is 15 percent or less and a more preferred distribution width is 15% or less. Here, the grain diameters are measured by the above-described method and the average grain diameter is obtained as a simple average.

Average grain diameter=$\Sigma dini/\Sigma ni$

The monodsipersed silver halide grains having core/shell used in the present invention have the grain structure composed of more than two layers having different silver iodide content in each layer and composed of the core (internal layer) and the shell covering the core. The shell is composed of one or more layers. It is preferable that the iodide content ratio of the core is different from that of the shell. In addition, it is particularly preferable to form a grain so as to have the highest iodine content ratio at the core portion.

It is preferable that the iodine content ratio in said core is more than 5 mole % and less than the limit forming a solid solution. It is more preferable that said ratio is more than 7 mole % and less than the limit forming the solid solution. In addition, it is preferable that the iodine content ratio of the core is more 3 mole % larger than that of the shell. The iodine distribution in the core is usually uniform but some distribution may be available. For example, it may be allowed to have a distribution such that the concentration increases from the center to the outside or has a minimum or maximum concentration along the width.

It is preferable to obtain the monodispersed silver halide grains of the core/shell type by the following procedures. Firstly, seed particles in an aqueous solution containing a protective colloid is prepared in a reaction vessel. Said monodispersed grains are obtained by making crystal growth of the seed grains with the supply of silver ions, halide ions or fne silver halide grains when required. In this case, the central portion of the grain may have different halide composition from that of the core.

Any halide compositions of said seed grains may be available and any of silver bromide, silver iodobromide, silver chloroiodobromide, silver chlorobromoiode, silver chloride, silver chloroiodide and silver iodide may be available.

It may be possible to make practically grains of a silver halide photographic emulsion round as defined previously in the presence of silver halide solvents such as ammonia, thioether, thiourea, thiocyanate, etc. which are known in the art as described in Japanese Patent Publication Open to Public Inspection No. 168734/1991.

It may be also possible to make the grains round as defined previously by increasing more than 1 of the pAg of the solution to which 70% of water-soluble silver halides are added as compared with the pAg of the said solution to which no silver halides are added in the course of the formation of silver halide grains.

For the emulsion which is prepared by said method above, it may be possible to make grains practically round by the addition and uniorm mixing of the suitable amount of the silver halide solvent at any time between the completion of the formation of the silver halide grains and the start of chemical ripening.

In addition, after the formation of the silver halide emulsion, the silver halide emulsion may be desalted (including water washing) before the treatment by solvents.

The silver halide grains used in the present invention can be prepared by any of acid methods, neutral methods or ammonia methods. They may be prepared with use of an ammonia silver nitrate solution at a pH of 7.5 or lower.

The silver iodide content ratio in each silver halide grain and average silver iodide content ratio can be obtained by the EPMA (Electron Probe Micro Analyzer) method. In this method, a sample is prepared in which the grains in an emulsion are dispersed so that grains have no contact each other. Then, electron beam is applied to the sample and the X-ray analysis is carried out by the electron beam excitation. It is possible to make the element analysis at a ultra-micro portion. This method makes it possible to measure the intensity of characteristic X-ray of silver and iodine emitted by each grain and decide the silver halide compositions of each grain. If the silver iodide content ratio is measured by the EPMA method for at least 50 grains, the average silver iodide content ratio is obtained as the average of the measured grains.

The distribution of silver halide composition at the inside of a silver halide grain is obtained as follows. In advance, the grain is sliced to a ultra-thin piece. While cooling the piece, it is observed and analyzed by a transmission electron microscope to obtain said distribution. In practice, a silver halide grain is picked up from the emulsion and then, is buried into a resin. The resin is cut by a diamond knife to prepare a slice with a thickness of 60 nm. While cooling the slice by liquid nitrogen, it is observed and point-analyzed by the transmission electron microscope equipped with an energy dispersion type X-ray analytical apparatus. Then, the distribution is obtained by the quantitative calculation. (Inoue and Nagasawa, Proceedings of the Annual Meeting of the Society of Photographic Science and Technology of Japan, 1987 page 62)

The silver iodide content ratio of the surface of a silver halide grain refers to the ratio from the surface to the depth of 50 Å that is analyzed by the XPS method (X-ray Photoelectron Spectroscopy) and is obtained as follows.

A sample is cooled at −110° C. or lower under ultra-high vacuum of $1\times10^{-8}$ torr or less. Then, the sample is irradiated by a probe X-ray of MgK $\alpha$ at 15 kV of X-ray generation voltage and 40 mA of the generation current and electrons of Ag3d5/2, Br3d and I3d3/2 are measured. The peak integration intensity measured is compensated by the Sensitivity Factor and the surface halide compositions are obtained by the intensity ratios.

In order to increase the measurement accuracy, the sample is cooled down so that it is not destroyed by the X-ray. At room temperature, the X-ray irradiation destroys the sample (decomposition of silver halide and diffusion of halide, specifically iodine) and results in measurement error. When cooled down to −110° C., the sample destruction can be retarded to such a level as no hindrance for the measurement.

A tablet grain may be a tabular silver halide grain having mutually two parallel twinning faces which are in parallel to the mutually parallel two principal (111) faces or may be a tabular silver halide grain having mutually parallel two (100) faces as the principal face.

A twinning is a silver halide crystal which has more than one of a twinning face in a grain. The crystallographic classification of the twinning is described in detail by Klein and Meuzer, Photographic Korrespondenz, Volume 99, page 99, ibid., Volume 100, page 57.

The twinning face can be observed by a transmission electron microscope. The practical method is as follows. Firstly, a silver halide photographic emulsion is coated on a support so that the silver halide grains contained are oriented on the support. The sample thus prepared is cut by a diamond cutter to obtain a slice of a thickness of about 0.1 $\mu$m. When the slice is observed by the transmission electron microscope, the presence of the twinning faces can be confirmed.

Regarding methods to prepare a tabular silver halide emulsion, it may be possible to use a method wherein silver halide is deposited on seed crystals. For the preparation of the tabular silver halide emulsion, in the preparation method of the silver halide photographic emulsion, wherein a water-soluble silver salt solution and a water-soluble halides solution are supplied in the presence of a protective colloid:

(a) Tabular nucleus forming process wherein silver salts and halide salts are introduced to a dispersion media (b) After the formation of the nucleus, Ostwald ripening process under the condition that a (100) or a (111) face is maintained (c) Grain growing process (grain forming process) wherein the seed grains are grown to the desired grain diameter and halide composition by the addition of a water-soluble silver salt solution and a halide salt solution and/or fine particles of halide:

may be used.

A tabular silver halide grain is a grain having two principal faces facing each other in mutually parallel. An aspect ratio is expressed by the ratio of a grain diameter against the grain thickness. The grain diameter in the present invention is the diameter (hereinafter referred to as grain diameter) of an average projection area and is a diameter of a circle corresponding to the projection area of said tabular silver halide grain (diameter of a circle having the same area as that of the projection area of said silver halide grain). The thickness is a distance between two parallel principal faces which form a tabular silver halide grain.

A preferred average value of the aspect ratio for tabular silver halide grains is 2 or more. In the present invention, in an emulsion layer comprising the tabular silver halide grains, 50% or more of the tabular silver halide grains are found in the total projection area. A preferred ratio is 70% or more and a more preferred is 90% or more. A preferred average grain diameter of the tabular silver halide grains is 0.15–5.0 $\mu$m, a more preferred is 0.4–3.0 $\mu$m and the most preferred is 0.4–2.0 $\mu$m.

A preferred average thickness of the tabular silver halide grains is 0.15–0.30$\mu$. The grain diameter and thickness can be optimized to make sensitivity, and the other photographic characteristics best. The optimized grain diameter and the optimized thickness vary according to the sensitivity and the other factors composing the light-sensitive materials which affect the other photographic characteristics (thickness of hydrophilic colloid layer, degree of degree of hardening, chemical ripening conditions, sensitivity specified to a light-sensitive material, coated silver amount, etc.).

It is preferable that silver halide grains have more uniform halide composition among grains. For example, when a iodine content distribution is measured by the EPMA method, a preferred relative standard deviation is 35% or less and the more preferred relative standard deviation is 20% or less.

The tabular silver halide grain may have dislocations. The dislocations can be observed, for example, by a direct method with use of a transmission electron microscope at low temperature as reported by J. F. Hamilton, Phot. Sci. Eng., 57 (1967) and T. Shibata, J. Soc. Phot. Sci. Japan, 35, 213 (1972). In practice, silver halide grains are taken out from an emulsion so that no pressure is applied to the grains to form dislocations and are placed on a mesh for the observation by the electron microscope. For preventing the damages (printing-out, etc.) by electron beam, the sample is observed by the transmission method. At the observation, the larger thickness of the grain becomes, the less electron beam transmits. In this case, an electron microscope of high voltage type (more than 200 kV for grain of 0.25 $\mu$m thickness) can permit clear observation.

It is preferable that the tabular silver halide grains are of a monodispersed emulsion having a narrow distribution width of grain diameters. In practice, a preferred distribution width defined by the following formula is 25% or less and a more preferred is 20% or less.

(Standard deviation of grain diameter/average grain diameter)×100=Distribution width of Grain diameter (%)

It is preferable that a distribution width of the thickness of the tabular silver halide grains is narrow. In practice, a preferred distribution width defined by the following equation is 25% or less and a more preferred is 20% or less.

(Standard deviation of thickness/average thickness)×100= Distribution Width of Thickness (%)

In order to obtain the silver halide grains, as to the conditions to grow seed grains prepared, it is pointed out that at the addition of water-soluble silver salt solution and a water-soluble halide solution, a double-jet method is applied and the rate of the addition is gradually changed in the range wherein no formation of new nucleus occurs as the seed grains grow and no Oswald ripening occurs, as disclosed in Japanese Patent Publication Open to Public Inspection Nos. 39027/1976, 142329/1980, 113928/1983, 48521/1979 and 49938/1983. occurs. As the other conditions to grow the seed grains, a method of growing grains through the recrystalization while dissolving added fine grains of silver halide may be used, as described in the Proceedings of the 1983 Annual Meeting of Photographic Science and Technology of Japan, 88 Item.

During the grain growth, an aqueous solution of silver nitrate and an aqueous solution of halides can be added by a double-jet method and in addition, iodine can be supplied to a system in a form of silver iodide. A preferred addition rate is such that no new nucleus is formed and no broadening of the distribution width occurs due to Ostwald ripening, that is, 30–100% range of the addition rate for the rate of the new nucleus formation.

When the silver halide emulsion used in the present invention is prepared, stirring conditions during the preparation are very important. A stirring apparatus used most preferably is such that a nozzle for an addition solution is placed, in a solution, near a mother solution inlet of the apparatus, as described in Japanese Patent Publication Open to Public Inspection No. 160128/1987. In addition, it is preferred that in this case, rotation for stirring is set at 100–1200 rpm.

In addition, when the emulsion is prepared, silver halide solvents as are known in the art such as ammonia, thioether, thiourea, etc. can be present during a seed grain forming process and a seed grain growing process. When silver halide grains are formed, it is possible to obtain grains having a desired grain diameter and distribution by the following method. A silver salt solution and a halide solution are added by a double jet method during the grain growth and the addition rate is controlled so that no new nucleus is formed and no broadening of the size distribution width occurs by Ostwald ripening, that is, the rate is gradually changed in the range of 30–100% for the new nucleus forming rate.

So-called halogen replacement type (conversion type) grains may be available as silver halide grains used in the present invention. A preferred halogen conversion ratio is 0.2 mole 0.5 mole % per silver weight. The replacement may be carried out during physical ripening and after the physical ripening.

As a method for the replacement of halogen, an aqueous halogen solution or fine silver halide grains are generally added which have less solubility product with silver than the halogen composition of the grain surfaces before the replacement. In this time, a preferred size of fine grains is 0.2 $\mu$m or less and the more preferred size is 0.2–0.1 $\mu$m.

Upon placing silver iodide in the top surface of a silver halide grain, there are the following methods; simultaneous addition of a silver nitrate solution and an iodine containing solution to an emulsion containing silver halide grains which work as bases; addition of fine silver halide grains such as sliver iodide, silver iodobromide, silver chloroiodobromide, etc.; addition of potassium iodide, a mixture of potassium iodide and potassium bromide, etc. Among these above, a preferred method is of the addition of the fine silver halide grains and the particularly preferred method is of the addition of fine silver iodide grains.

The time for controlling the silver iodide content ratio in said top surface is available during the period of the final step of silver halide crystal preparing process, of the chemical ripening process and of the coating solution preparing process just before the coating of the silver halide emulsion. It is preferable to control the content before the end of the chemical ripening process. In the present invention, said chemical ripening process refers to the process from the completion of physical ripening and salt removing process for the silver halide emulsion of the present invention, to the addition of chemical sensitizers and further to the completion of the operation to stop chemical ripening. In addition, silver halide fine grains may be added several times taking intervals between the additions and after the addition of said fine grains, the other emulsion which has undergone chemical ripening may be added.

A preferred temperature range of the liquid emulsion of the present invention when silver halide fine grains are added is 30°–80° C. and the particularly preferred temperature is 40°–65° C. In the present invention, preferred conditions are such that all or a part of the added fine silver halide grains disappear just before the coating after the addition. The more preferred conditions are such that 20% or more of the added fine silver halide grains disappears just before the coating.

In the present invention, in order to accelerate development speed, it is preferable to add silver halide solvents before a salt removing process. For example, it is preferable to add thiocyanate compounds (potassium thiocyanate, sodium thiocyanate, ammonium thiocyanate, etc.) of $1\times10^{-3}$ mole or more, or $3\times10^{-2}$ mole or less per 1 mole of silver or.

As a protective colloid dispersion medium for silver halide grains, it is preferable to use gelatin. Gelatin includes alkali-treated gelatin, acid-treated gelatin, low molecular weight gelatin (molecular weight of 10,000–50,000), modified gelatin such as phthalated gelatin, etc. In addition, the other hydrophilic colloids can be used. In practice, materials are described in Research Disclosure (hereinafter referred to as RD), Volume 176, Item 17643 (December, 1978).

During the preparation of silver halide grains, soluble salts which are not necessary at the growth of silver halide grains may be removed or not removed. For removing said salts, methods described in RD Volume 176, No. 17643, Item 11 can be used.

In addition, to the silver halide grains used in the present invention, during the grain forming process and/or grain growing process is added at least one metal ion selected from cadmiun salts, zinc salts, lead salts, thallium salts, iridium salts (including complex salts), rhodium salts (including complex salts) and iron salts (including complex salts) so that the metal elements can be contained in and/or on the grains and in addition, reduction sensitization specks can be provided in and/or on the grains when placed in an appropriate reduction environment.

In addition, it is preferable to deactivate the function of reducing agents which are added at the desired timing of the grain formation by the addition of oxidizing agents such hydrogen peroxide (aqueous solution), its addition products, peroxo acid salts, ozone or $I_2$ at the desired timing.

Oxidizing agents may be added at any time after the formation of silver halide grains before the addition of gold sensitizers in the chemical sensitization process (before the addition of chemical sensitizers if the gold sensitizers are not used.).

The silver halide grains of the present invention can undergo chemical sensitization. Conditions for chemical ripening or chemical sensitization process such as, for example, pH, pAg, temperature, time, etc. have no special limitation and can be carried out under the ordinary conditions used in this industries. For practicing the chemical sensitization, a sulfur sensitization method utilizing sulfur containg compounds or active gelatin which can react with silver ions, a selenium sensitization method utilizing selenium compounds, a tellrium sensitization method utilizing tellrium compounds, a reduction sensitization method utilizing reducing agents and a noble metal sensitization method utilizing gold or the other noble metals can be used independently or in combination.

The addition amount of the selenium sensitizers is generally approximately $10^{-8}$–$10^{-4}$ mole per 1 mole of silver, though the addition varies according to used selenium compound, silver halide grain, chemical ripening conditions, etc. The selenium compounds may be added after dissolving them into water or organic solvents such methanol or ethanol, or mixed solvents. In addition, the compounds are preliminarily mixed with a gelatin solution and are added. A method disclosed in Japanese Patent Publication Open to Public Inspection No. 140739/1992 may be used, wherein the compounds are added in a form of a colloid dispersion consisting of a mixed solution of an organic solvent-soluble polymer.

A preferred temperature for the chemical ripening with use of selenium sensitizers is 40°–80° C. and the more preferred temperature is 45° C. or more and 80° C. or lower. A preferred pH is 4–9 and a preferred pAg is 6–9.5.

The application technologies for the tellurium sensitizers is subject to those for the selenium sensitizers.

It is also preferable to perform reduction sensitization on a grain surface while placing the grains under the reduction environment. Examples of preferred reducing agents include thiurea dioxide and ascorbic acid and their derivatives. The other preferred reducing agents include hydrazine, polyamines such as diethylene triamine, dimethyl boranes, sulfite salts, etc.

It is preferable that the addition amount of the reducing agents varies according to environmental conditions such as agents' kinds, grain diameter of silver halide, silver halide composition and crystal habit, temperature, pH and pAg of a reaction system, etc. For example, as a rough standard, the addition of 0.01–2 mg thiourea dioxide per 1 mole of silver gives a preferred result. A preferred addition amount of ascorbic acid is approximately 50 mg–2 g per 1 mole of silver.

As the conditions for reduction sensitization, it is preferable that temperature is about 40°–70° C., time is about 10–200 minutes, pH is about 5–11 and pAg is about 1–10 (here, pAg value is a reciprocal of $Ag^+$ ion concentration)

As water-soluble silver salts, silver nitrate is preferable. By the addition of the water-soluble silver salts, silver ripening, one of reduction sensitization technologies, is carried out. A suitable pAg at the silver ripening is 1–6 and a preferred pAg is 2–4. Preferred conditions such as temperature, pH, time, etc. are the same as the above-described ranges.

The silver halide grains of the present invention may be spectrally sensitized by methine dyes and others. Available dyes include cyanine dyes, merocyanine dyes, complex cyanine dyes, complex merocyanine dyes, homopolar cyanine dyes, hemicyanine dyes, styryl dyes and hemioxinol dyes. Particularly useful dyes are those of the cyanine dyes, the merocyanine dyes and the complex merocyanine dyes.

Any of nuclei which are ordinarily used are applied to these dyes. The nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, pyridine nucleus, etc. and nuclei formed by the linkage of the above mentioned nuclei with aliphatic hydrocarbon rings such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, quinoline nucleus, etc. These nuclei may have substituents at the carbon atoms.

To the merocyanine dyes or complex merocyanine dyes, can be applied 5–6 membered heterocyclic nuclei having a ketomethine structure such as a pyrazoline-5-on nucleus, a thohydantoin nucleus, a 2-thiooxazolizine-2,4-dione nucleus, a thiazoline-2,4-dione nucleus, a rhodanine nuceus, a thiobarbituric acid nucleus, etc.

The said spectral sensitizers may be used independently or in combination which is often applied to the purpose of spectral supersensitization. In addition, dyes, themselves having no capability of spectral sensitization or compounds having no substantial absorption of visiblle light which show supersensitization action may be incorporated in emulsin layers together with the spectral sensitizers. For example, substituted aminostilbene compounds having a heterocyclic group having nitrogen atom (for example, compounds disclosed in U.S. Pat. Nos. 2,933,390, 3,635,721), aromatic organic acid formaldehye condensation products (for example, compounds disclosed in U.S. Pat. No. 3,743,510), cadmiun salts, azaindene compounds may be incorporated.

The combinations disclosed in U.S. Pat. Nos. 3,615,613, 3,615,641, 3,617,295, 3,635,721, etc.) are specially useful. The spectral sensitizers can be added at any time during the process of nucleus formation, growth, salt removal, chemical sensitization, or between the processes, or after the chemical sensitization.

In order to make said light-sensitive materials of the present invention suitable for rapid processing, it is preferable that suitable amount of hardening agents is added to said material at the coating process and the water content in said light-sensitive materials is kept low by controlling water swelling ratio during processes of development—fixing—washing.

In addition, a preferred water swelling ratio of the silver halide light-sensitive material of the present invention is 150–250% during development processing and a preferred layer thickness after water swelling is 70 $\mu$m or less. When the water swelling ratio is 250% or more, poor drying occurs which causes troubles, for example, transport trouble especially at rapid processing using an automatic processor.

In addition, when the material is developed under the water swelling ratio of less than 150%, an adverse trend such as an increase in streak and remaining dye stain is found here, Here, the water swelling ratio is obtained in such a way that the difference between the layer thickness before development and after each processing is divided by the thickness before the processing and then, multiplied by 100.

In the present invention, solid processing agents having shapes such as powder, tablets, pellets granules, etc. may be used. In addition, the agents which have undergone waterproof treatment may be used if required.

In the present invention, the powder means an aggregate of fine crystals. In the present invention, the granule means grains having the diameter of 50–5,000 $\mu$m, which are prepared by a grain forming process from powder. In the present invention, the tablets refers to ones obtained by compression-molding powder or granules into a definite shape.

In order to decrease the variation of photographic properties, it is effective to decrease a aperture coefficient. A specifically preferred aperture coefficient is 80 $m^2$/l or less. If the aperture coefficient is larger than 80 $cm^2$/l, undissolved solid processing agents and concentrated solution after dissolving the agents are subject to aerial oxidation and as a result, insoluble matters and scums are formed. Then, light-sensitive materials suffers the problems such as stain. However, if the aperture coefficient is 80 $cm^2$ or less, the problems are solved. Here, the aperture coefficient is expressed as an air contacting area for the unit volume of a processing solution and the unit is $cm^2$/l. In the present invention, a preferred aperture coefficient is the aperture coefficient is preferably less tha 80 $cm^2$, more preferably 50–3 $cm^2$/l and further more preferably 35–10 $cm^2$/l.

The aperture coefficient can be generally decreased by a floating resin lid which shields contact with air or by a slit type development apparatus disclosed in Japanese Paten Publication Open to Public Inspection Nos. 131138/1988, 216050/1988, 235940/1988.

The solid processing agents used in the present invention may be used as photographic processing agents such as a developer, a fixer, a rinsing agent, etc. Among them, the developer shows the largest capability for effects of the present invention, particularly an effect of stablizing photographic properties.

As for the solid processing agents used in the present invention, the present invention includes the agents in which one component is only solidified. However, it is preferred that all the components of said processing agents are solidified. It is preferable that each component is solidified as an independent solid processing agent and solid agents are packed in one box. In addition, it is preferable that different components are packaged in order of the repeated addition.

As for the means for supplying the solid processing agents to processing tanks in the present invention, for example, when the solid processing agents are in a form of tablets, methods are disclosed in Japanese Utility Model Nos. 137783/1988, 97522/1988 and 85732/1989. In short, any method may be used provided that the method has at least as function for supplying the tablets to processing tanks. In case the solid processing agents are of granules or powder, there are publicly known methods such as dropping methods utilizing gravity disclosed in Japanese Patent Publication Open to Public Inspection Nos. 81964/1987, 84151/1988 and 292375/1989 and methods utilizing propellers or screws disclosed in Japanese Patent Publication Open to Public Inspection Nos. 105159/1988 and 195345/1988. However, the present invention shall not be limited thereto.

Any position in a processing vessel may be available for adding the solid processing agents of the present invention. The preferred position is the place to which a processing portion for processing light-sensitive materials is connected and in which the processing solution flows from said processing portion. In addition, the preferred structure is such that the processing solution circulats at the constant rate between processing portions and dissolved components move to the processing portion. It is preferred that the solid processing agents are added to processing solutions of which temperatures are conditioned.

In addition, as developing agents in the processing agents used in the present invention, it is preferred to use dihydroxybenzene derivatives, aminophenol derivatives and pyrazolidones derivatives disclosed in Japanese Patent Application Open to Public Inspection No. 138591/1994 (pages 19–20) and in addition, reductones disclosed in Japanese Patent Application Open to Public Inspection No. 165161/1993. Among the pyrazolidone derivatives, those having a substitute especially at the 4 position (dimeson, dimeson S, etc.) are particularly preferable in terms of solubility in water and stablity of solid processing agents themselves during storage.

As preserving agents can be used sulfites disclosed in Japanese Patent Application No. 286232/1992 or organic reducing agents. In addition to those agents, it is possible to use chelating agents and addition compounds of bisulfite salts with hardeners disclosed in Japanese Patent Application No. 586323/1992 (pages 20–21). In addition, as antisludging agents for silver, it is preferable to add compounds (general formula [4-a] or [4-b]) disclosed in Japanese Patent Application Nos. 92947/1992 and 96118/1993. The addition of cyclodextrin compounds is preferable and compounds disclosed in Japanese Patent Application Open to Public Inspection is particularly preferable.

To developing agents can be added amine compounds, for example, as particularly preferable compounds disclosed in U.S. Pat. No. 4,269,929.

It is necessary to use buffering agents in the developing agents. The buffering agents include sodium carbonate, potassium carbonate, sodium bicarbonate, potassium bicarbonate, trisodium phosphate, tripotassium phosphate, dipotassium phosphate, sodium borate, potassium borate, sodium tetraborate (boric acid), potassium tetraborate, sodium o-hydroxybenzonate (sodium salicylate), potassium o-hydroxybenzonate, sodium 5-sulfo-2-hydroxybenzonate (sodium 5-sulfosalicylate), potassium 5-sulfo-2-hydroxybenzonate (potassium 5-sulfosalicylate), etc.

As development accelerators an be optionally added thioether compounds, p-phenuylenediamine compounds, quaternary ammonium salts, amine compounds, polyalkylene oxides, 1-phenyl- 3-pyrazolidone derivatives, hydrozine derivatives, neso-ionic compounds, ionic compounds, imidazole derivatives.

As antifogging agents, can be used alkali metal halides such as potassium iodide and organic antigogging agents. The organic antigogging agents include, for example, nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazorylbenzimidazole, 2-thiazorylmethylbenzimidazole, indazole, hydroyazaindolidine and adenine. As an example of the antifogging agents, 1-phenyl-5-mercaptotetrazole can be shown.

In addition, in order to increase the solubility of the developing agents, methylcellosolve, methanol, acetone, dimethylformamide, cyclodextrin compounds and compounds disclosed in Japanese Patent Examined Publication Nos. 33378/1972 and 9509/1969 may be used as organic solvents. In addition, various other additives such as antistaining agents, antisludging agents, interimage effect enhancing agents, etc may be added.

Fixing agents which are publicly known as fixing agents may be added. Fixing agents, chelating agents, pH buffering agents, hardening agents, preserving agents may be used. For example, may be used the compounds disclosed in Japanese Patent Publication Open to Public Inspection Nos. 242246/1992 (page 4) and 113632/1993 (pages 2–4). In addition to these compounds, addition compounds of bisulfite salts with hardening agents and fixing acceleraters publicly known may be used.

Prior to processing, it is desirable to add a starter and to add the starter in solid shape. The starters include organic acids such as polycarboxylic acid compounds, halides of alkali metals such as Kbr, organic inhibitors and development accelerators.

The present invention may be applied to black and white silver halide light-sensitive photographic materials (for example, light-sensitive materials for medical use, light-sensitive materials for printing use, negative light-sensitive materials for general use, etc,) and light-sensitive color photographic materials (for example, light-sensitive materials for color negative, light-sensitive materials for color reversal, light-sensitive materials for color print, etc.), light-sensitive materials for diffusion transfer, light-sensitive materials for heat development and the others. Among those applications, the present invention may be more favorably applied to the black and white light-sensitive photographic materials.

Generally speaking, in developing solutions used for the developing process for the black and white light-sensitive photographic materials, hydroquinone derivatives are used. However, in the present invention, from a standpoint of the improvement of work safety and the environmental protection, developing solutions containing ascorbic acid without hydroquinone may be used, for example, as disclosed in U.S. Pat. No. 5,236,816.

The development time for the black and white light-sensitive photographic materials of the present invention is 3–90 seconds. The more preferred development time is 5–60 seconds. The processing time of Dry to Dry is 15–210 seconds and the preferred time is 15–90 seconds.

As for the silver halide light-sensitive photographic materials of the present invention, various additives may be further added to the silver halide emulsions corresponding to requirements. Examples of used additives and others are found in, for example, Rearch Disclosure Nos. 17643 (December 1978), 18716 (November 1979) and 308119 (December 1989).

The supports which may be used for the silver halide light-sensitive photographic materials include, for example those described in said Research Disclosure No. 17643 page 28 and No. 308119 page 1009.

The pertinent supports include a plastic film, etc. In order to improve the adhesion of the support surface to a coating layer, a subbing layer may be provided, or corona discharge or ultraviolet radiation may be applied.

EXAMPLES

The examples of the present invention will be explained below, but the present invention is not limited thereto.

Example 1

(Preparation of Seed Emulsion A)

| | |
|---|---|
| A1 Solution | |
| Ossein Gelatin | 37.5 g |
| KI | 0.625 g |
| NaCl | 16.5 g |
| With distilled water | 7500 ml |
| B1 Solution | |
| Silver Nitrate | 1500 g |
| With distilled water | 2500 ml |

-continued

| (Preparation of Seed Emulsion A) | |
|---|---|
| C1 Solution | |
| KI | 4 g |
| NaCl | 140 g |
| With distilled water | 684 ml |
| D1 Solution | |
| NaCl | 375 g |
| With distilled water | 1816 ml |

By the use of a mixing stirrer described in Japanese Patent Publication No. 58288/1983, at 40° C., 684 ml of the B1 Solution and the total of the Cl solution were added to the A1 solution for 1 minute. After the EAg was adjusted to 149 mV, the emulsion underwent Ostwald ripening for 20 minutes. Then, the total of the remaining B1 Solution and the total of the D5 Solution were added to the emulsion for 40 minutes, while keeping the EAg at 149 mV.

After completing the addition, the emulsion was desalted and washed. The resulted emulsion was coded as the seed emulsion EM-A. It was found by an electron microscope that the seed emulsion A thus prepared was composed of tabular grains, in which 60% or more of the total projection area of the silver halide grains had (100) faces as the principal, 2 or more of the aspect ratio, the average thickness of 0.07 $\mu$m, the average diameter of 0.5 $\mu$m and the variation coefficient of 25%.

(Preparation of Emulsion B)

A tabular silver iodochloride emulsion was prepared by the following 4 solutions.

| | |
|---|---|
| A2 Solution | |
| Ossein Gelatin | 29.4 g |
| $HO(CH_2CH_2)_m—(CH(CH_3)CH_2O)_{17}—(CH_2CH_2O)_n—H$ (m + n ≈ 5.7 Molecular Weight 1700) (10% Methanol Solution) | 1.25 ml |
| Seed Emulsion A | equivalent to 0.98 mole |
| Distilled water to make | 3000 ml |
| B2 Solution | |
| 3.5 N Aqueous solution of silver nitrate | 2240 ml |
| C2 Solution | |
| NaCl | 455 g |
| Distilled water to make | 2240 ml |
| D2 Solution | |
| 1.75 N Aoueous solution of NaCl | Amount to control the following silver potentail |

By the use of a mixing stirrer described in Japanese Patent Publication No. 58288/1983, the total of the B2 Solution and the total of the C2 Solution were added at 40° C. to the A2 Solution by a simultaneous mixing method (double-jet method) for 110 minutes so that the the flow rate of the addition at the end of the addition becomes 3 times of the initial rate of the addition. During the addition, the Eag was kept at 120 mV with the addition of the D2 solution.

After the completion of the addition, in order to remove the excess salts, the resulted solution was precipitated and washed. Then, about 3000 grains of the resulted Emulsion B was observed and measured by an electron microscope. When the shapes were analyzed, it was found that 80% or more of the projection area was composed of tabular grains which have (100) faces as a principal face, the aspecto ratio of 2 or more, the average diameter of 1.17 $\mu$, the average thickness of 0.12 $\mu$, and the variation coefficient of 25%.

| (Preparation of Fine Grains of Silver Iodide) | |
|---|---|
| A3 Solution | |
| Occein Gelatin | 100 g |
| KI | 8.5 g |
| Distilled water to make | 2000 ml |
| B3 Solution | |
| Silver nitrate | 360 g |
| Distilled water to make | 605 ml |
| C3 Solution | |
| KI | 352 g |
| Distilled water to make | 605 ml |

The A3 Solution was placed in a reactor. The B3 solution and the C3 Solution were added under stirring to the A3 Solution at 40° C. by a double-jet method for 30 minutes with a low flow rate. During the addition, the pAg was kept at 13.5 by a conventional method. The average diameter of resulted silver iodide grains was 0.06$\mu$. The resulted emulsion is called silver iodide fine grains.

(Preparation of Solid Fine Particle Dispersion of Spectral Sensitizer)

100 parts of 5,5'-dichloro-9-ethyl-3,3'-di-(3-sulfopropyl)-oxacarbocyanine sodium salt anhydride (spectral sensitizer A) and 1 part of 5,5'-di-(butoxycarbonyl)-1,1'-diethyl3,3'-di-(4-sulfobutyl)-benzoimidazolocarbocyanine sodium salt anhydride (spectral sensitizer B) were added to water previously kept at 27° C. and the solution was stirred by a high speed stirrer (Dissolver) at 35000 r.p.m. for 30–120 minutes to obtain the solid fine particles dispersion of the spectral sensitizers. At the time, the concentration of the spectral sensitizers were adjusted to 2%.

(Chemical Sensitization)

The emulsion B underwent spectral sensitization and chemical sensitization by the following method. Then, the chemically sensitized emulsion was obtained.

After the emulsion was heated to 60° C., said solid fine particles dispersion was added of the amount equivalent to 460 mg of said spectral sensitizer A per 1 mole of silver halide. Then, after the addition of $7\times10^{-4}$ mole of ammonium thiocyanate and $3\times10^{-6}$ mole of potassium chloroaurate, sodium thiosulfate and triphenylphosfine selenide, the emulsion underwent chemical sensitization under the optimum conditions. After the ripenng, said silver iodide fine grain emulsion was added and then the resulted emulsion was satbalized by the additikon of $1\times10^{-2}$ mole of 4-hydroxy-6-methyl-1,3,3a,7-tetrazaindene. (each addition amount per 1 mole of silver halide)

By the addition of the following additives, a coating solution for an emulsion layer was prepared. At the same time, a coating solution for a protective layer was prepared.

(Preparation of Support 1)

The corona discharge of 0.5 kV·A·min/m$^2$ was applied to both sides of polyethyleneterephthalate film base (thickness 175$\mu$) dyed in blue color of the density of 0.170 for X-rays use. Then, a latex solution described in L-2 for a subbing layer was coated on the resulted film base so that the layer thichness after drying was 0.2$\mu$ and L-1 shown below was coated so that the layer thickness after drying is 0.053$\mu$ and dried for 2 minutes at 123° C. This support is called Support

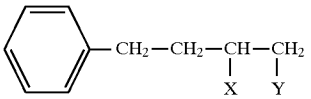

(L-1)

Where

X:COOH or COONa

Y:COONa or $COOCH_2CF_2CF_2H$ (L-2)

Copolymer latex solution (solid portion 30%) composed of n-butylacrylate 10 weight percent, t-butylacrylate 35 weight percent, styrene 27 weight percent and 2-hydroxyethylacrylate 28 weight percent.

(Preparation of Support 2)

On one side of a blue stained polyethylene terepgthalate film base subjected with corona discharge treatment as Support 1 was provided a subbing layer which was the same as that of said Support 1 and, on the other side of the film base was coated a coating composition comprising the colloidal tin oxide prepared according to (Example 1), the above-described (L-2) composition and the following (L-4) composition in the volume ratio of 35:15:50 at a level of the dry thickness of 0.12 $\mu$m and the coated tin oxide component of 250 mg/m$^2$. Then, a coating composition which was prepared by maixing the above described (L-1) and the following (L-3) in the volume ratio of 70:30 was simultaneously coated on both sides of the resulted base at a level of the dry thickness of 0.053 $\mu$m and was dried at 120° C. for 1 minute.

(L-3)

Ester exchange reaction was performed under nitrogen gas flow at 170°–220° C. for a mixture consisting of dimethyl terephthalate 34.02 weight parts, dimethyl isophthalate 25.52 weight parts, dimethyl 5-sulfoisophthalate sodium salt 12.97 weight parts, ethylene glycol 47.85 weight parts, 1,4-cyclohexane dimethanol 18.95 weight parts, calcium acetate monohydride 0.065 weight part and mangan acetate tetrahydride 0.022 weight parts, while disposing methanol. Then, trimethyl phosphate 0.04 weight part, antimony trioxide as polycondensation catalyst 0.04 weight part and 4-cyclohexanedicarboxylic acid 15.08 weight parts were added to the resulted solution and esterification was performed at 220°–235° C. while removing the amount of water near the theoritical value. After that, the inside of the reaction vessel was evacuated for one hour and heated until 280° C. and 1 mmHg or less were obtained. Under the above condition, the polycondensation was carried out for about one hour and a polyester polymer (intrinsic viscosity 0.35) was obtained.

To 7300 g of the obtained aqueous polyester polymer composition were added styrene 30 g, butylmethacryrate 30 g, glycindilmethacryrate 20 g, acrylamide 20 g and ammonium persulfate 1.0 g. The mixture was reacted at 80° C. for 5 hours and was cooled to room temperature. A coating composition was then prepared by adjusting the solid content at 10%.

(L-4)

Copolymer latex composition comprising n-butylacryrate 40 weight %, styrene 20 weight % and glycidilmethacryrate 40 weight %.

(Preparation of Support 3)

On one side of a blue stained polyethylene terepgthalate film base subjected with corona discharge treatment as Support 1 was provided a subbing layer which was the same as that of said Support 1 and, on the other side of the film base was coated a coating composition comprising dispersion of tin oxide powder III described in Example 1 of Japanese Patent Unexamined Publication No. 58-62647 so as to have an amount of 250 mg/m$^2$ of the tin oxide. Then, a coating composition which was prepared by mixing the above described (L-1) and (L-2) used in Example 2 was coated. The film was dried at 123° C. for 2 minute. The resulted film is called as Support 3.

(Preparation of Support 4)

On one side of a blue stained polyethylene terepgthalate film base subjected with corona discharge treatment as Support 1 was provided a subbing layer which was the same as that of said Support 1 and, on the other side of the film base was coated a coating composition comprising dispersion of zinc oxide described in Example 1 of Japanese Patent Unexamined Publication No. 58-62646 so as to have an amount of 250 mg/m$^2$ of the zinc oxide. Then, a coating composition which was prepared by mixing the above described (L-1) and (L-2) used in Example 2 was coated. The film was dried at 123° C. for 2 minute. The resulted film is called as Support 4.

(Preparation of Support 5)

On one side of a blue stained polyethylene terepgthalate film base subjected with corona discharge treatment as Support 1 was provided a subbing layer which was the same as that of said Support 1 and, on the other side of the film base was coated a coating composition comprising dispersion of vanadium oxide described in Example 13 of U.S. Pat. No. 4,203,769, the above-described (L-2) composition and the (L-4) composition in the volume ratio of 35:15:50 at a level of the dry thickness of 0.12 $\mu$m and the vanadium amount of 250 mg/m$^2$. The film was dried at 120° C. for 1 minute. The resulted film is called as Support 5.

(Preparation of Light-sensitive Materials)

On the both sides of said Supports 1, 2, 3, 4 and 5, dextran having the average molecular weight of 40,000 was added to the first layer (a crossover cut layer) mentioned below at a level of 0.08 g/m$^2$ and the second layer (an emulsion layer) at a level of 0.2 g/m$^2$ as shown in Table 2. As described below, each coating composition after additives were added was uniformly coated on the both sides in order of the crossover cut layer, the emulsin layer and the protective layer and was dried. Then, samples 1–8 shown in Table 2 were obtained.

The coatings were controlled at a level of 1.5 g Ag/m$^2$, 1.0 g gelatin m$^2$ in the emulsion layer, 0.4 g gelatin/m$^2$ in the protective layer and 0.2 g gelatin/m$^2$ in the crossover cut layer.

| The First Layer (Crossover Cut Layer) | |
|---|---|
| Gelatin | 0.2 g/m$^2$ |
| Solid fine particle dispersion dye (AH) | 20 mg/m$^2$ |
| Sodium dodecylbenzenesulfonate | 5 mg/m$^2$ |
| Compound (I) | 5 mg/m$^2$ |
| 2,4-dichloro-6-hydroxy-1,3,5-triazine sodium salt | 5 mg/m$^2$ |
| Colloidal silica (average diameter 0.014 $\mu$m) | 10 mg/m$^2$ |
| The Second Layer (Emulsion Layer) | |
| The following various additives were added to the emulsions obtained previously. | |
| Comound (G) | 0.5 mg/m$^2$ |
| 2,6-bis(hydoxyamino)-4-diethylamino-1,3,5-triazine | 5 mg/m$^2$ |
| t-butylcatechol | 5 mg/m$^2$ |
| Polyvinyl pyrrolidone (molecular weight 10,000) | 20 mg/m$^2$ |
| Styrene-maleic acid anhydride copolymer | 80 mg/m$^2$ |
| Sodium polystyrenesulfonate | 80 mg/m$^2$ |
| Trimethylol propane | 350 mg/m$^2$ |
| diethlene glycol | 50 mg/m$^2$ |
| Nitrophenyltriphenylphosphonium chlorid | 1 mg/m$^2$ |

-continued

| | |
|---|---|
| Ammonium 1,3-dihydroxybenzen-4-sulfonate | 50 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 20 mg/m$^2$ |
| Compound (M) | 5 mg/m$^2$ |
| Compound (N) | 5 mg/m$^2$ |
| Colloidal silica | 0.5 g/m$^2$ |
| Latex (L) | 0.5 mg/m$^2$ |
| Sodium styrenesulfonate (molecular weight approximately 500,000) | 7 mg/m$^2$ |
| The Third Layer (Protective Layer Under Layer) | |
| Gelatin | 0.4 mg/m$^2$ |
| Dioctylphthalate | 195 mg/m$^2$ |
| Sodium styrenesulfonate (moleciar weight approximately 500,000) | 7 mg/m$^2$ |
| The Forth Layer (Upper Layer on Protective Layer) | |
| Gelatin | 0.28 g/m$^2$ |
| Matting agent composed of polymethylmethacryrate (area average grain diameter 7.0 $\mu$m) | 27 mg/m$^2$ |
| 2,4-dichloro-6-hydroxy-1,3,6-triazine sodium salt | 10 mg/m$^2$ |
| Latex (L) | 0.2 mg/m$^2$ |
| Polyacrylamide (average molecular weight 10,000) | 0.1 g/m$^2$ |
| Sodium polyacrylate | 30 mg/m$^2$ |
| Compound (SI) | 50 mg/m$^2$ |
| Compound (I) | 30 mg/m$^2$ |
| Compound (S-1) | 7 mg/m$^2$ |
| $C_9F_{19}-O-(CH_2CH_2O)_{11}-H$ | 3 mg/m$^2$ |
| $C_8F_{17}SO_2N(C_3H_7)(CH_2CH_2O)_{15}-H$ | 2 mg/m$^2$ |
| $C_8F_{17}SO_2N(C_3H_7)(CH_2CH_2O)_4-(CH_2)_4SO_3Na$ | 1 mg/m$^2$ |
| $C_7F_{15}CH_2(CH_2CH_2O)_{13}H$ | 10 mg/m$^2$ |

Note: coated amounts of materials for one side

Latex (L)

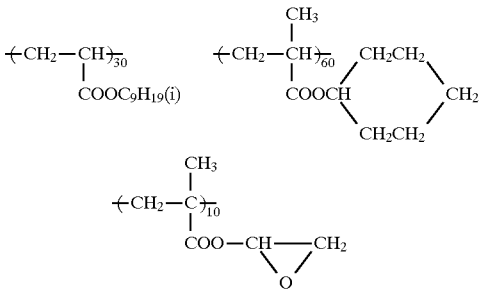

Compound (I)

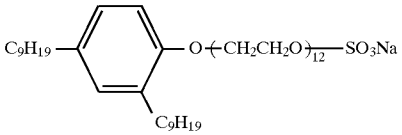

Compound (G)

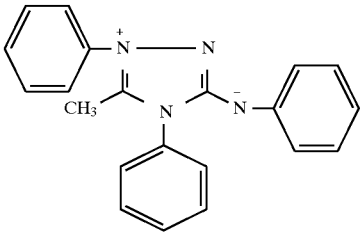

-continued

Compound (H)

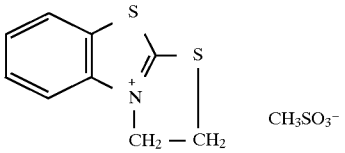

Solid fine particle dispersion dye (AH)

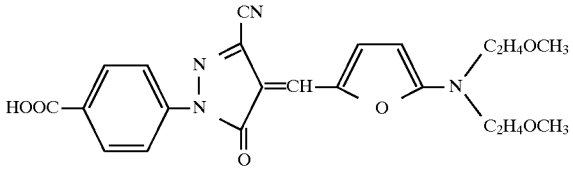

Compound (M)

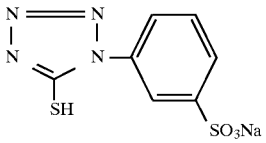

Compound (N)

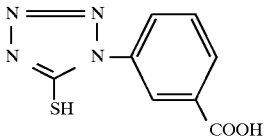

Compound (SI)

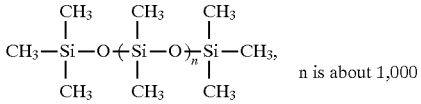

n is about 1,000

Compound (S-1)

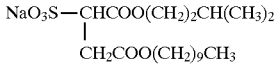

(Preparation of Tablets for Developer Replenisher)

The tablets for the developer replenisher were prepared by the following Procedures (A) and (B).

Procedure (A)

In a bandam mill available on the market, 3000 g of hydroquinone was crushed into fine grains having the average diameter of 10 $\mu$m. To the fine grains are added 3,000 g of sodium sulfite, 2,000 g of potassium sulfite and 1,000 g of dimeson S (Trade name of 1-phenyl-4-hydroxymethyl-4-methyl-3-pyrazolidone) and were mixed in tha mill for 30 minutes. The resulted mixture was granulated by adding 30 ml of water at room temperature for about 10 minutes in a stirring granulator available on the market. Then, the resulted granules were dried at 40° C. for 2 hours in a fluidized bed dryer and water in the granules was almost completely removed. The dried granules were added with 4 g of sodium N-lauroylalanine and the mixture was uniformly mixed for 10 minutes in a mixer installed in a room which was conditioned at 25° C. and 40% RH or less. Then the resulted mixture was compression-tableted by a modified Tough Pressto Correct Model 1527HU manufactured by Kikusui Seisakusho Co., Ltd. The filling amount for tableting was set at 3.84 g per one tablet and 2,500 tablets for the Replenisher were prepared.

Procedure (B)

100 g of DTPA (diethylenetriaminepentaacetic acid 5 sodium salt), 4,000 g of potassium carbonate, 10 g of 5-methylbenztriazole, 7 g of 1-phenyl-5-mercaptoterazole, 5 g of 2-mercaptohypxantine, 200 g of KOH and 10 g of N-acetyl-D,L-penicilamine were crused in fine grains and granulated by the same manners as those of the Procedure (A). The addition amount of water was 30 ml. After the granulatin, water in the granules was removed almost completely by drying at 50° C. for 30 minutes. Dried granules were compression-tableted by the tablet machine used for the Procedure (A). The filling amount was set at 1.73 g per one tablet and 2,500 tablets were prepared for the developer replenisher B.

(Preparation of Tablet for Fixing Replenisger)

The tablets for the fixing replenisher were prepared by the following procedure.

Procedure (C)

14,000 g of ammonium thiosulfate/sodium thiosulfate (70/30 weight ratio) and 1,500 g of sodium sulfite were crushed into fine grains by the same manner as that od the Procedure A and were uniformly mixed by a mixer available on the market. Then, 500 ml of water was added to the resulted mixture and the granulation was carried out by tha same procedure as that of the Procedure (A). Water in the granules was removed almost completely. The dried granules were mixed with 4 g of sodium N-lauroylalanine for 3 minutes by a mixer which was installed in a room conditioned at 25° C. and 40% RH or lower. The resulted mixture was compression-tableted in an filling amount of 6.202 g per tablet by the above-mentioned tableting machine and 2,500 tablets were prepared for the fixer replenisher C.

Procedure (D)

1,000 g of boric acid, 1,500 g of aluminum sulfate octadeca hydrate, 3,000 g of sodium hydrogen acetate (dried mixture of glacial acetic acid and sodium acetate in the same mole each other) and 200 g of tartaric acid were crused into fine grains and granulated in the same manner as in the Procedure (A). The addition amount of water was 100 ml. After the granulation, the franules were dried at 50° C. for 30 minutes and water in the grnules was removed almost completely.

The granules thus prepared were added with 3 g of sodium N-lauroylalanine and mixed for 3 minutes. The resulted mixture was compression-tableted in an filling amount of 4.562 per tablet and 1,250 tablets were prepared for the fixing replenisher D.

| (Development Processing for Light-sensitive Materials) | |
|---|---|
| Developer Starter | |
| Glacial acetic acid | 2.98 g |
| Kbr | 4.9 g |
| Water to make 1 liter | |

At a start of processing of developer (start of running), the 434 tablets each of A and B for developing replenisher were dissolved into a diluting water to make a 16.5 liters developing solution and 330 ml of the starter was added thereto to prepare a developing starting solution. The developer vessel was charged with the starting solution and the processing started. The pH of the developer to which the starter was added was 10.45. Tablets C in amount of 298 g and Tablets D in amount of 149 g for fixing replenisher were dissolved into a diluting water to make a 11.0 liters to prepare the fixing vessel solution.

The samples were exposed at a level of the optical density of 1.0 after development processing and reunning was carried out. For the running, an automatic processor model SRX-502 manufactured by Konica Corporation equipped with a supply mechanism for the solid processing agents was modified so that the processing finished within 25 seconds.

During the running, to the developer, were added each two tablets of said A tablet and B tablet and water of 76 ml per 0.62 $m^2$ of the light-sensitive material. When the A tablet and B tablet were dissolved into each of 28 ml of water, the pHs were 10.70. To the fixing solution, were added two C tablets and one D tablet, and 74 ml of water per 0.62 $m^2$ of the light-sensitive materials. The addition water per tablet was initiated at the almost same time when the processing agents were added and the water addition rate was kept at the constant for the first ten minutes being proportional to the dissolving speed of the processing agents.

| Processing conditions | | |
|---|---|---|
| Development | 35° C. | 8.2 seconds |
| Fixing | 33° C. | 5 seconds |
| Washing | Room temperature | 4.5 seconds |
| Squeezing | | 1.6 seconds |
| Drying | 40° C. | 5.7 seconds |
| | Total | 25 seconds |

(Evaluating of Frequency of Static Mark)

The samples obtained without exposure were conditioned to 20% relative humidity or less at 25° C. for 2 hours. Then, the samples were rubbed independently by a Neoprene rubber roller and a Nylon roller and were subjected to said development process. The following standards were used for evaluation.

A: No static marks are found.

B: Some static marks are found.

C: Many static marks are found,

D: Static marks are found on the whole area.

(Evaluation for Layer Adhesion)

The samples were exposed and were processed by said processing method. The film samples developed to black were conditioned to 70% relative humidity at 23° C. for 2 hours. Then, the conditioned samples were rubbed ten times between the length of 20 cm by a sapphire needle with the weight load of 500 g at a speed of 30 cm/second. Emulsion peeling was evaluated by the formation of scratch according to the following standards.

A: No scratch is found.

B: A few scratches are found by a ten times magnifying glass. However, in practice, no trouble occur.

C: A few scratches are found by the naked eye.

D: Emulsion peeling is clearly found and the occurrence of scratches is in a level of problem.

E: The occurrence of scratches is large and is a level of no practical use.

(Evaluation for Remaing Dye Stain)

Unexposed samples were processed by said processing method and were evaluated by the following standards.

A: No remaining dye stain is found.

B: When carefully observed, an edge portion of the film sample looks slightly reddish with unevenness. However, in practice, no problem occurs.

C: When carefully observed, an edge portion of the film sample looks unevenly reddish. However, in practice, no problem occurs.

D: Uneven reddish pattern at the center of the film sample is found. In practice, a problem will occur.

E: Uneven red pattern at the center of the film sample is found. No practical use is possible.

Obtained results are shown in Table 2.

TABLE 2

| Sample No. | Support | Dextran Added Layers | Static Marks | Layer Adhesion | Remaining Dye Stain | Comment |
|---|---|---|---|---|---|---|
| 1 | 1 | None | C | C | D | Control |
| 2 | 2 | None | A | C | D | Control |
| 3 | 2 | 1st Layer | A | A | A | Invention |
| 4 | 2 | 2nd Layer | A | A–B | A | Invention |
| 5 | 1 | 2nd Layer | C | B | B | Control |
| 6 | 3 | 2nd Layer | A–B | A–B | A | Invention |
| 7 | 4 | 2nd Layer | A–B | A–B | A | Invention |
| 8 | 5 | 2nd Layer | A | A–B | A | Invention |

As is clearly shown in Table 2, the samples of the present invention form less static marks and are excellent at the layer adhesion after the development process. In addition, it is found that the samples of the present invention carry less remaining dye stain.

Example 2

Instead of the dextran in Example 1, the compounds (A-1), (A-9) and (A18) of the general formula (1) were used to prepare samples 6–12. The addition amounts are shown in Table 3. The samples were prepared by the same procedures as those in Example 1 besides the addition of the compounds in Table 3. The samples were evaluated in the same manner done for Example 1. Table 3 shows the results obtained.

TABLE 3

| | General Formula (1) Compounds | | | | | | | |
|---|---|---|---|---|---|---|---|---|
| Sample No. | Support | Kind | Addition Amount | Added Layer | Static Marks | Layer Adhesion | Remaining Dye Stain | Comments |
| 9 | 1 | None | — | — | C | C | D | Control |
| 10 | 2 | None | — | — | A | C | D | Control |
| 11 | 2 | A-1 | $5 \times 10^{-5}$ mole/mole of AgX | 1st Layer | A | A | A | Inv. |
| 12 | 2 | A-1 | $3 \times 10^{-4}$ mole/mole of AgX | 2nd Layer | A | A–B | A | Inv. |
| 13 | 1 | A-1 | $3 \times 10^{-4}$ mole/mole of AgX | 2nd Layer | C | B | B | Control |
| 14 | 2 | A-9 | $3 \times 10^{-4}$ mole/mole of AgX | 2nd Layer | A | A–B | A | Inv. |
| 15 | 2 | A-18 | $3 \times 10^{-4}$ mole/mole of AgX | 2nd Layer | A | A–B | A | Inv. |
| 16 | 3 | A-1 | $3 \times 10^{-4}$ mole/mole of AgX | 2nd Layer | A–B | A–B | A | Inv. |
| 17 | 4 | A-1 | $3 \times 10^{-4}$ mole/mole of AgX | 2nd Layer | A–B | A–B | A | Inv. |
| 18 | 5 | A-1 | $3 \times 10^{-4}$ mole/mole of AgX | 2nd Layer | A | A–B | A | Inv. |

Note: Inv. stands for Present Invention.

As is clearly shown in Table 3, the samples of the present invention are excellent at antistatic properties (capability of preventing the formation of static marks) and the layer adhesion after development processing. In addition, it is found that silver halide light-sensitive photographic materials having less remaining dye stain are obtained.

The present invention provides a silver halide light-sensitive photographic material and its processing method having excellent antistatic properties (capability of preventing the formation of static marks) and layer adhesion after development processing, and in addition, no remaining dye stain.

I claim:

1. A silver halide light-sensitive photographic material comprises hydrophilic colloid layers at least one of which is a silver halide emulsion layer, and a subbing layer on a support, wherein at least one of the hydrophilic colloid layers contains dextran and the subbing layer contains a metal oxide selected from the group consisting of colloidal $SnO_2$, colloidal ZnO, and colloidal $V_2O_5$.

2. A silver halide light-sensitive photographic material as claimed in claim 1 wherein the dextran is a polymer of D-glucose linked at the α-1,6 positions.

3. A silver halide light-sensitive photographic material as claimed in claim 1 wherein the dextran is contained in a hydrophilic colloid layer nearest to the subbing layer.

4. A silver halide light-sensitive photographic material as claimed in claim 1 wherein an amount of dextran is 5–50 weight percent of total weight of binders in the hydrophilic colloid layers.

* * * * *